United States Patent [19]

Young

[11] 3,937,284

[45] Feb. 10, 1976

[54] EXOTHERMIC CHEMICAL REACTIVE SPRINKLER RELEASE

[76] Inventor: Richard J. Young, 2131 SW. 42, Oklahoma City, Okla. 73119

[22] Filed: Sept. 30, 1974

[21] Appl. No.: 510,687

[52] U.S. Cl. ..... 169/37; 169/42

[51] Int. Cl.[2] ..... A62C 37/18

[58] Field of Search ..... 169/37, 38, 39, 40, 41, 169/26, 42

[56] References Cited

UNITED STATES PATENTS

| | | | |
|---|---|---|---|
| 278,654 | 5/1883 | Buell | 169/38 |
| 849,938 | 4/1907 | Thurlow et al. | 169/38 X |
| 2,075,816 | 4/1937 | Loepsinger et al. | 169/39 |

*Primary Examiner*—Evon C. Blunk
*Assistant Examiner*—Michael Mar
*Attorney, Agent, or Firm*—Robert K. Rhea

[57] ABSTRACT

A thermally sensitive stored chemical energy capsule is formed in the heat collector or attached to the fusible link of existing thermally sensitive sprinkler heads for activating individual sprinkler heads by heat generated by the intermingling of the capsule contained chemicals.

6 Claims, 5 Drawing Figures

EXOTHERMIC CHEMICAL REACTIVE SPRINKLER RELEASE

BACKGROUND OF THE INVENTION

1. Field of the Invention.

The present invention relates to fire detecting systems and more particularly to a stored chemical energy capsule for thermally sensitive sprinkler heads for actuating the sprinkler heads by an exothermic chemical reaction.

Conventional fire protection systems installed in department stores, office buildings, and the like, employ a sprinkler system including sprinkler heads arranged in selected spaced-apart relation with each sprinkler head maintained in a closed position by a fusible link. This link is normally fused by ambient heat, therefore, when a fire occurs it must burn and increase in intensity to a degree which will melt or fuse the link or links of sprinkler heads. Since these fusible links are made of low melting point metallic material, it seems obvious that the necessary heat to achieve the fusing action is a result of considerable flame having been generated. It seems obvious that if one or more sprinkler heads can be actuated or released in the area where the fire begins, assuming that the fire is not caused by a chemical explosion, then the release of a single sprinkler head would snuff out a fire in its initial stage or stages. This controlling of a fire or fires in their initial stages would not only conserve considerable merchandise but would result in less smoke and water damage being done as normally occurs when conventional sprinkler systems are activated as a result of a fire.

SUMMARY OF THE INVENTION

In one embodiment the bell-shaped strut supported heat collector forming one-half of a fusible link in a conventional sprinkler, concentrically receives a water containing case forming a chamber at the inner end of the bell-shaped heat collector which contains a thermally expansive liquid and sodium. The case is provided with a frangible wall adjacent the chamber capable of being ruptured by expansion of the thermally sensitive liquid to intermingle the water and sodium for an exothermic chemical reaction and melting the fusible link.

In another embodiment the water case is disposed within a bell-like member contacting a thermally sensitive link and having a sodium containing chamber adjacent the link.

The principal object of this invention is to provide an exothermic chemical reactive capsule for a thermally sensitive sprinkler head for melting the fusible sprinkler release.

DESCRIPTION OF THE PREFERRED EMBODIMENTS

Figure 1:
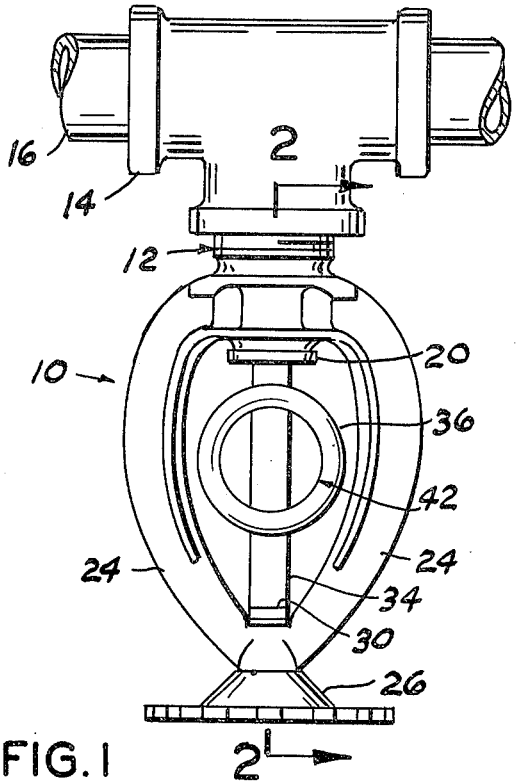
FIG. 1 is an elevational view of a conventional sprinkler head connected with a fragment of a water supply line.

Like characters of reference designate like parts in those figures of the drawings in which they occur.

In the drawings:

The reference numeral 10 indicates a conventional sprinkler head, marketed Nationally by Grinnell Fire Protection Systems Co., used in fire protection systems. The sprinkler head 10 includes a valve body 12 threadedly connected with a tee 14 interposed in a selected location within a fluid conducting line 16. The valve body is provided with an orifice 18 normally closed by a valve or cap 20 held in place by lever arms, indicated generally at 22. The lever arms 22 comprise brace members 24, secured to the valve body at one end and connected with a fluid dispersing flange 26 at their other ends. A release lever 28, substantially L-shaped in side elevation (FIG. 2), has the free end portion of its foot portion 30 contacting the juncture of the arcuate arms 24 and its leg portion 32 projecting toward the valve body 12 in off-set spaced relation with respect to the vertical plane of the arcuate arms 24. A strut 34 extends, intermediate its ends, diametrically through a bell-shaped heat collector 36 and bears against the cap 20, at one end, and against the foot portion 30 of the L-shaped lever, at its other end, in off-set relation with respect to the axis of the orifice 18. The closed end surface 37 of the collector 36 is sweat soldered to a cup-shaped member 38 in turn connected to the arm leg 32 so that movement of the lever leg portion 32 away from the collector, by melting the fusible solder joint 40 (FIG. 3), permits fluid pressure contained by the line 16 to unseat the cap 20 and discharge water aginst the flange 26 which in turn forms a spray of the fluid from line 16. The above description is conventional with this type of sprinkler head and is set forth to show the operability of the instant invention.

Figure 2:
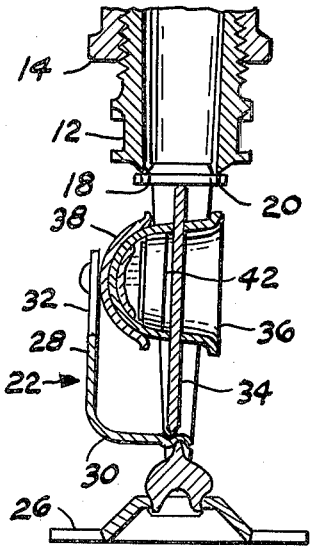
FIG. 2 is a vertical cross sectional view taken substantially along the line 2—2 of FIG. 1 illustrating the relative postition of the stored chemical energy capsule.
Figure 3:
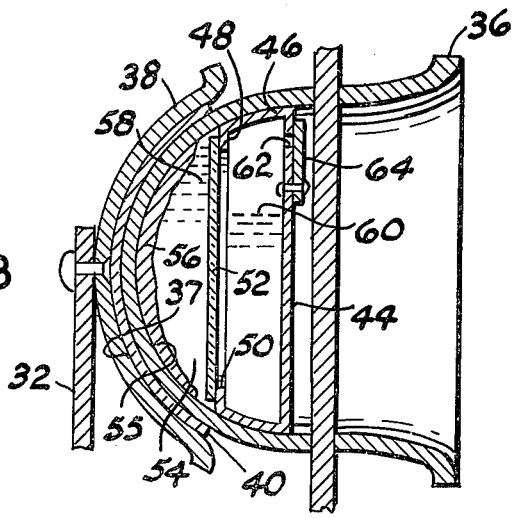
FIG. 3 is a cross sectional view of a portion of FIG. 2, to an enlarged scale.

In carrying out the invention and referring more particularly to FIGS. 1 to 3, a generally circular metal case 42, having a flat front wall 44 and an arcuate side wall 46, adapted to contiguously contact and be sealed fluid tight with a portion of the inner surface of the bell-shaped heat collector wall is transversely disposed therein inwardly of the strut 34. The annular flange-like back wall 48 of the case defines an opening 50 normally closed by a relatively thin frangible disk formed of brittle material, such as glass 52 bonded to the flange wall 48. The case thus acts as a double walled hollow partition and forms a chamber 54 within the closed end of the heat collector 36. The inner wall surface 55 of the heat collector closed end inwardly of the case 42 is coated with a layer of metallic sodium 56. The remaining area of the chamber 54 is filled with a heat expansible medium, such as liquid 58, preferably having a specific gravity less than water and inert with sodium, such as kerosene, with the combined volume of the sodium and liquid being equal to the volume of the chamber 54. The metal case 42 is substantially filled with water 60. The case front wall 44 is provided with a vent hole 62 normally closed by a pressure release valve or flap valve 64.

Figure 5:
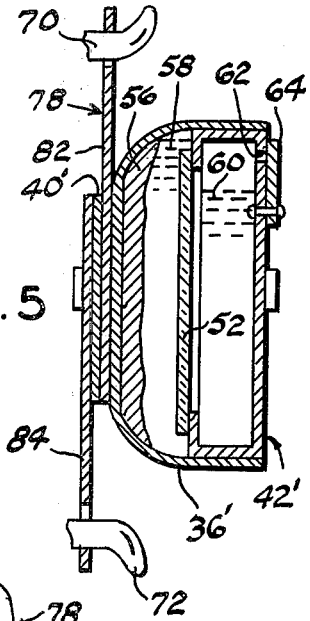
Figure 4:
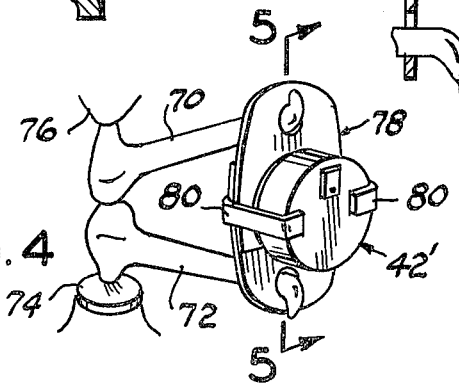
FIG. 4 is a fragmentary perspective view illustrating the stored chemical energy capsule connected with another type conventional sprinkler head; and, FIG. 5 is a fragmentary vertical cross sectional view, to a larger scale, taken substantially along the line 5—5 of FIG. 4.

Referring more particularly to FIGS. 4 and 5, a fragment of another type sprinkler head is illustrated which employs a pair of arms 70 and 72 normally biased away from each other at one end by their other ends being juxtaposed in off-center frictional engagement between an orifice closing valve or cap 74 and a dispersing flange 76. The normally vertically spaced-apart ends of the arms 70 and 72 are joined by a fusible element or link 78. In this embodiment the water containing case 42' is disposed within a bell-shaped member 36' and forms a closed chamber 54' containing the sodium 56 and kerosene 58. The closed end of the member 36' contiguously contacts a flat surface of the fusible link 78 and is held in place by any suitable means, such as bonding, not shown, or by clip means 80.

OPERATION

In operation heat generated by a fire in the vicinity of one of the sprinkler heads 10 heats the liquid (kerosene) 58 which expands and ruptures the disk 52 allowing an intermingling of the water 60 with the sodium 56. The chemical reaction generates hydrogen gas and heat. The hydrogen gas being vented through the case front wall aperture 62 and the heat serving to melt the fusible joint 40 thus releasing the arm 28 and activating the sprinkler.

Operation of the embodiment of FIGS. 4 and 5 is substantially identical in that heat generated by the sodium and water melts the fusible joint 40' securing the fusible link members 82 and 84 together thus permitting separating action of the sprinkler head arms 70 and 72.

Obviously the invention is susceptible to changes or alterations without defeating its practicability, therefore, I do not wish to be confined to the preferred embodiment shown in the drawings and described herein.,

I claim:

1. An exothermic release for a thermally sensitive sprinkler head having a fusible element normally maintaining the sprinkler head inactive, the improvement comprising:

a thermally sensitive heat generating capsule disposed adjacent said fusible element, said capsule confining a heat expansible medium with a quantity of sodium and containing water; and, partition means capable of being ruptured by the expansion of said expansible medium beyond a predetermined limit for commingling said sodium and water and fusing said fusible element, normally separating said sodium and expansible medium from said water.

2. The combination according to claim 1 in which said partition means includes:

a hollow case containing the water and transversely dividing said capsule and forming a closed chamber for containing the sodium and the expansible medium, said case having a frangible wall adjacent the chamber.

3. The combination according to claim 2 in which the expansible medium comprises:

a liquid inert with the sodium and completely filling the chamber in combination with the sodium.

4. The combination according to claim 3 in which the inert liquid has a specific gravity less than water.

5. The combination according to claim 3 in which said frangible wall is glass.

6. The combination according to claim 5 and further including:

a pressure release valve communicating with said case.

* * * * *